United States Patent [19]

Lowe

[11] 4,448,318

[45] May 15, 1984

[54] TAMPER EVIDENT CONTAINER-CLOSURE ASSEMBLY

[75] Inventor: Allen D. Lowe, Montgomery, Pa.

[73] Assignee: The West Company, Phoenixville, Pa.

[21] Appl. No.: 410,047

[22] Filed: Aug. 20, 1982

[51] Int. Cl.[3] ..... B65D 41/34

[52] U.S. Cl. ..... 215/252

[58] Field of Search ..... 215/252

[56] References Cited

U.S. PATENT DOCUMENTS

| | | | |
|---|---|---|---|
| 3,504,818 | 4/1970 | Crisci et al. | 215/252 |
| 3,874,540 | 4/1975 | Hidding | 215/252 |
| 4,225,050 | 9/1980 | Reinhart | 215/252 |

*Primary Examiner*—Donald F. Norton

*Attorney, Agent, or Firm*—Eugene E. Renz, Jr.

[57] ABSTRACT

A closure for containers having a discharge opening and a finish with means for supporting the closure over the discharge opening comprising a cap portion of generally cup-like form having a top and a depending skirt with means on the interior peripheral surface thereof cooperating with means on the container finish for applying and removing the cap portion; a tamper-evident ring or band connected to the lower terminal edge of said skirt by at least a pair of fracturable bridge means and at least one lug cooperatively associated with at least one cam element below the container finish operable in one direction of movement of the cap portion relative to the container to effect fracturing of the bridge means to separate the tamper-evident ring from the cap portion, said bridge means being oriented in a predetermined manner relative to one another to effect sequential breaking in a given pattern upon relative movement of said cap portion and ring in said one direction.

4 Claims, 23 Drawing Figures

TAMPER EVIDENT CONTAINER-CLOSURE ASSEMBLY

FIELD OF THE INVENTION

The present invention relates to closures and specifically to so-called tamper-evident closures characterized by novel features of construction and arrangement providing visual indicia or evidence of removal of the closure so that the purchaser or user may be assured that the contents of the container are as originally packaged.

DESCRIPTION OF THE PRIOR ART

Tamper-evident closures are not new, per se. These prior closures generally comprise a cap of cup-like form which is internally threaded so that it may be threaded onto complementary threads on the neck of a container, and a tamper-evident ring connected to the lower terminal edge of the skirt of the cap by fracturable bridges. The tamper-proof ring has internal projections or lugs which cooperate with cam elements on the container neck finish permitting rotation of the cap in one direction to apply it to the container without fracturing the bridge connections and upon rotation of the cap in the opposite direction to remove it from the container, the lugs on the tamper-evident ring engage with shoulders of the cam elements to prevent relative rotation of the ring and thus sever the bridges. In some instances the skirt then is free to drop axially to provide a gap between the skirt and the ring. This gap and the fractured bridges are visual evidence to the user that the closure has once been opened. An example of this type of tamper-evident closure is shown in the Crisci et al U.S. Pat. No. 3,504,818 issued Apr. 7, 1970. While this closure is generally effective for the purposes intended, there are certain disadvantages in the operation and use of this type of closure resulting mainly from the orientation of the fracturable bridges. For example, in the Crisci closure, the bridges connecting the skirt of the cap to the ring all are radially oriented and of the same length and therefore when the cap is rotated to remove it, all the bridges fracture simultaneously. The torque required to remove these closures in some instances is excessive by reason of the fact that the bridges collectively must be simultaneously fractured upon rotation of the cap in a direction to remove it. Further, it has been found that in applying this closure to the container, in some instances the flexing of the ring when the lugs pass over the cams results in premature fracturing of the bridges when applying the closure to the container which, of course, is undesirable.

There are other similar closure container assemblies having tamper-evident means generally similar to that shown in the Crisci Patent:

| | | |
|---|---|---|
| Hidding | 3,874,540 | April 1, 1975 |
| Conti | 4,062,466 | December 13, 1977 |
| Bardell | 3,415,403 | December 10, 1968 |
| Dold | 4,081,097 | March 28, 1978 |
| Kern et al | 3,310,191 | March 21, 1967 |
| Julian | 3,967,745 | July 6, 1976 |
| Miller | 3,650,428 | March 21, 1972 |
| Fields et al | 3,455,478 | July 15, 1969 |

These likewise, have the disadvantage and drawback noted above in regard to initial application of the closure to the container and potential fracturing of the bridges connecting the tamper-evident ring to the cap as well as difficult torque removal levels.

The patent to Winchell et al U.S. Pat. No. 4,177,905 issued Dec. 11, 1979 is also of interest in that it shows a double seal arrangement for sealing the cap on the closure. The upper seal which is mounted in a pocket formed on the inside of the top of the cap seats against the axial end face or pouring lip of a container and the second seal is snugly fitted onto the container neck between a pair of radially projecting axially spaced ribs on the container finish below the screw threads. The second stressed sealing ring is engaged by the lower terminal edge of the skirt when the cap is applied to the container and pressed against the radially projecting lower flange on the container finish. This assembly is rather expensive to assemble by reason of the separate application of the lower seal.

Other prior art patents of interest showing closure sealing means include:

| | | |
|---|---|---|
| Sohl | 676,160 | June 11, 1901 |
| Lampman | 795,626 | July 25, 1905 |
| Terrill | 2,014,093 | Sept. 10, 1935 |
| Deschner | 2,056,171 | Oct. 6, 1936 |
| Brasington | 2,302,835 | Nov. 24, 1942 |
| Isele | 2,339,702 | Jan. 18, 1944 |
| Mumford | 3,286,868 | Nov. 22, 1966 |
| Mumford | 3,411,649 | Nov. 19, 1968 |
| Asmus et al | 3,428,202 | Feb. 18, 1969 |
| Hammes | 3,480,169 | Nov. 25, 1969 |
| Lecinski et al | 3,603,472 | Sept. 7, 1971 |

SUMMARY OF THE INVENTION

The present invention provides a tamper-evident closure having novel double-seal capabilities which is characterized by novel features of construction and arrangement obviating some of the disadvantages and drawbacks of the prior closures discussed above. To this end, the closure of the present invention includes a cap of cup-like form, a tamper-evident ring connected by fracturable bridges to the lower terminal edge of the skirt of the cap and first seal means formed integrally on the interior of the top of the cap to seal with the axial end face of the container and second seal means formed integrally adjacent the lower edge of the skirt which seats on a single radially projecting flange below the threads on the neck of the container when the cap is fully seated. The flange also has a cam configuration with which lugs on the tamper-evident ring cooperate and which ratchet over the cams when the cap is initially applied to the container and interengage with the shoulder portions of the cam elements to fracture the bridges when the cap is removed. However, in the present instance, the bridges which are preferably equispaced circumferentially are disposed at different angles relative to one another. In this manner, the skirt can flex slightly radially without fracturing the bridges when it is applied to the container and upon removal, the bridges fracture sequentially. This arrangement reduces considerably the torque required to remove the cap initially.

With the foregoing in mind, it is an object of the present invention to provide an improved closure assembly having novel tamper-evident means which is easy and economical to manufacture and is readily applicable to a container without risk of fracturing the connecting bridges and which may when desired be readily removed from the container with application of a minimum amount of torque.

A further object of the present invention is to provide an improved tamper-evident closure assembly for a container including a tamper-evident ring connected to the cap portion of the closure by a series of fracturable bridge connections which are oriented in a predetermined manner to break sequentially with a relatively small angular rotation of the cap and ring relative to one another when it is desired to remove the cap portion from the container and activate the tamper-evident ring.

Still a further object of the present invention is to provide an improved closure having tamper-evident features wherein the tamper-evident ring is connected by a series of connecting bridges which are disposed angularly at different angular configurations to effect the sequential breaking action.

Still another object of the present invention is to provide a closure having a tamper-evident feature wherein the connecting bridges are of V-shaped cross section and the included angle of each connecting bridge is different.

Still another object of the present invention is to provide a closure having a tamper-evident feature wherein the connecting bridges are of arcuate cross section and wherein the radius of curvature of each of the bridges is selectively varied to effect the sequential breaking action when the closure is actuated in a direction to fracture the bridges and cause separation of the tamper-evident ring from the cap portion.

Still another object of the present invention is to provide a closure of the above type providing an effective seal with the container when it is fully seated thereon.

DESCRIPTION OF THE DRAWINGS

These and other objects of the present invention and the various features and details of the operation and construction thereof are hereinafter more fully set forth with reference to the accompanying drawings, wherein.

DESCRIPTION OF THE PREFERRED EMBODIMENTS

Figure 2:
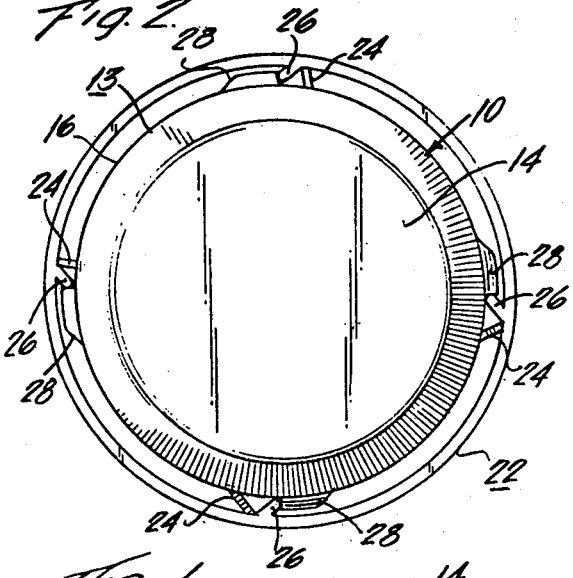
FIG. 2 is a top plan view thereof.

Referring now to the drawings, and particularly to FIGS. 1–9 thereof, there is illustrated a container closure assembly in accordance with the present invention, the closure being generally designated by the numeral 10 and the general designation for the container being 12.

Figure 5:
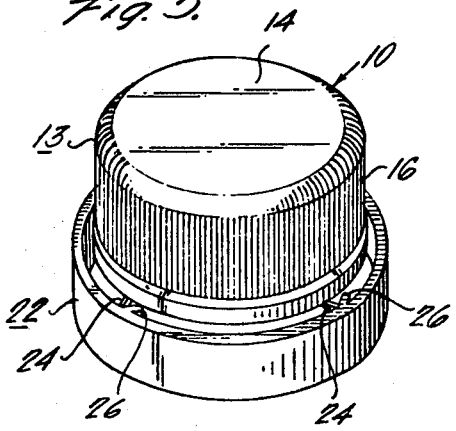
FIG. 5 is a perspective view of the cap of the present invention.
Figure 1:
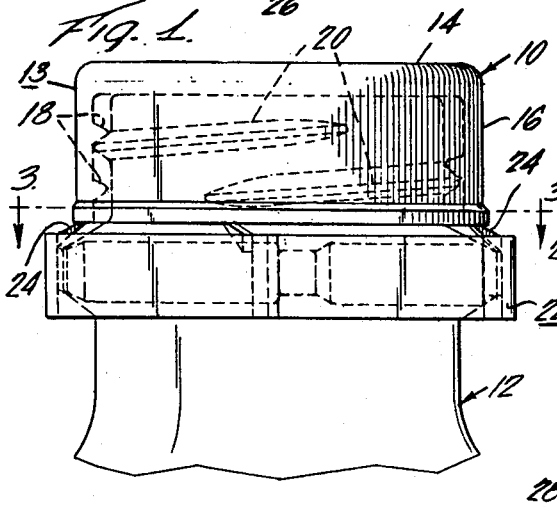
FIG. 1 is a fragmentary side elevational view of one embodiment of a container closure assembly in accordance with the present invention.
Figure 6:
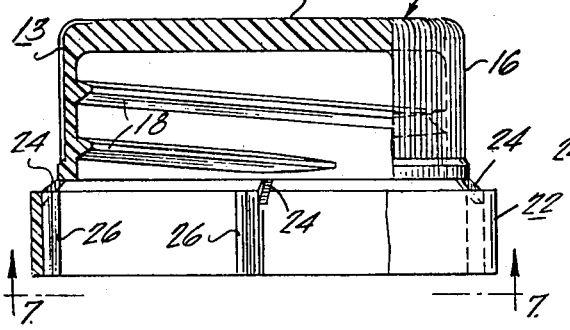
FIG. 6 is a side elevational view partly in section of the cap.
Figure 7:
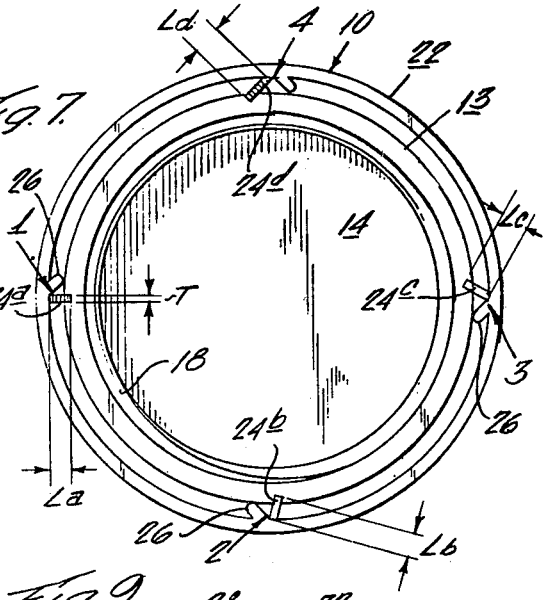
FIG. 7 is a bottom plan view thereof.
Figure 8:
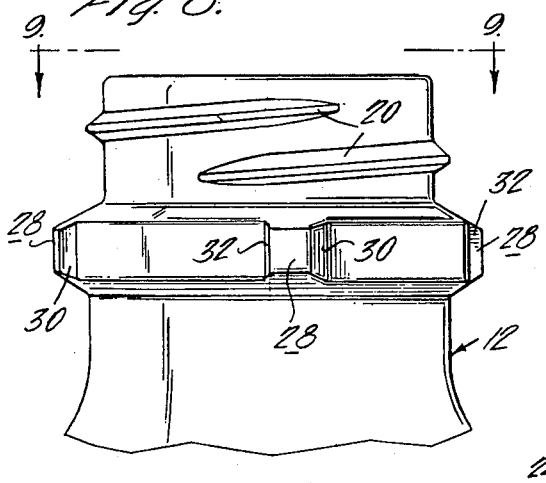
FIG. 8 is a side elevational view of the container neck.
Figure 9:
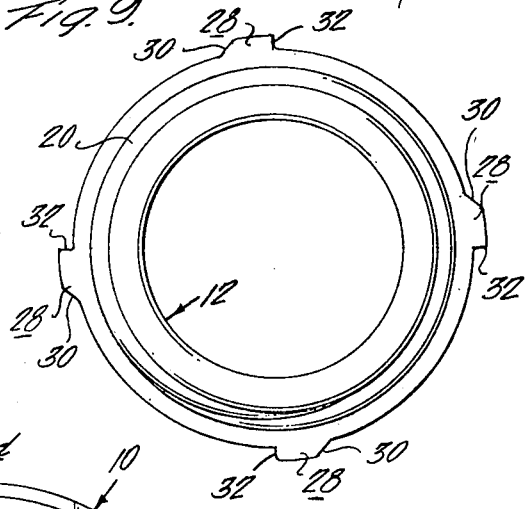
FIG. 9 is a top plan view thereof.
Figure 10:
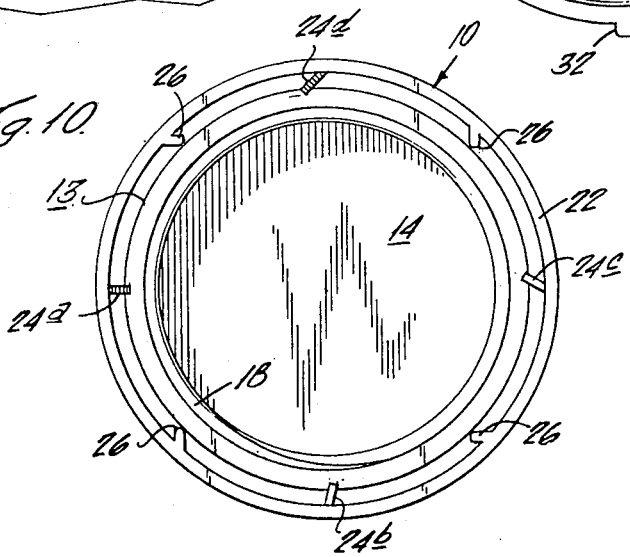
FIG. 10 is a bottom plan view of a modified form of closure where the connecting bridges and tamper-evident ring lugs are circumferentially spaced or staggered.
Figure 16:
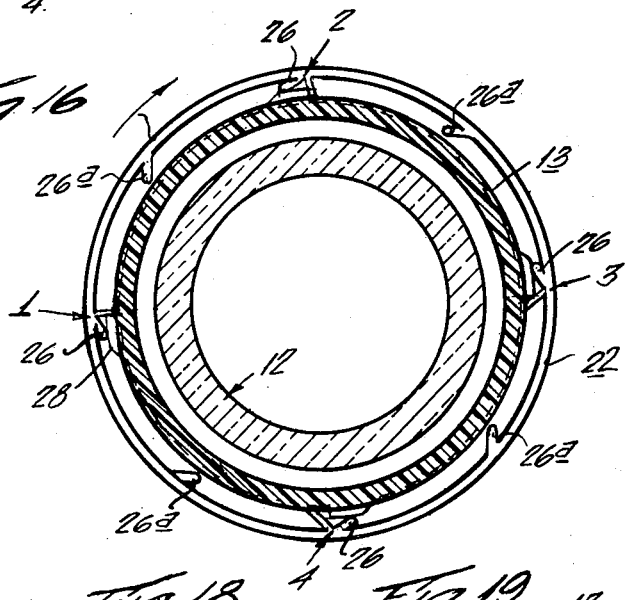
FIG. 16 is a sectional view showing a still further modification including additional lugs and also illustrating the position of the lugs riding over the cams when applying the cap.
Figure 17:
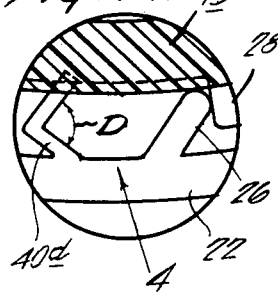
FIGS. 17 and 18 are enlarged fragmentary sectional views showing the bridge configuration of the FIG. 14 embodiment, FIG. 18 showing the extended bridge after fracturing.
Figure 18:
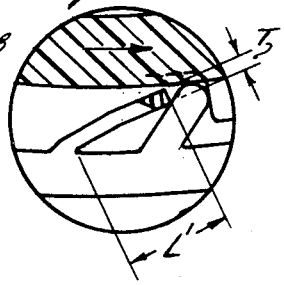
Figure 19:
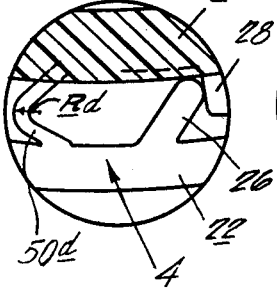
FIGS. 19 and 20 are enlarged fragmentary views similar to FIGS. 17 and 18 except pertaining to the arcuate bridge of FIG. 15.
Figure 20:
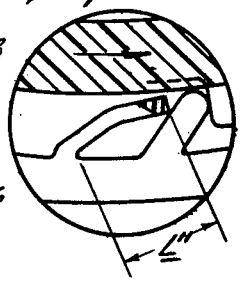

The closure 10 which is preferably made of a plastic material, such as polypropylene, as best illustrated in FIGS. 1, 5 and 6, comprises a cap 13 of cup-like form having a top 14 and a depending peripheral skirt 16 having internal threads 18 which cooperate and mate with a thread finish 20 on the neck of the container so that the cap may be applied and removed from the container by a rotating action. The closure further includes a tamper-proof or tamper-evident annular member or ring 22 connected to the cap by a plurality of circumferentially spaced fracturable bridge connections 24. The ring 22 has a plurality of radially inwardly directed, circumferentially spaced lugs 26 which cooperate with a series of radially outwardly projecting, circumferentially spaced cam elements 28 on the neck of the container below the screw threads 20 shaped to permit override of the lugs 26 during assembly of the cap initially and with which the lugs 26 engage when the cap is rotated in a reverse direction to remove it from the container to effect fracturing of the connecting bridges 24 and separation of the ring 22 and cap 13. To this end, each of the cam elements 28 as illustrated has an inclined ramp section 30 and a radial shoulder 32. In this manner as the cap is applied to the container and rotated in the direction to seat it, the lugs 28 initially engage the inclined ramp sections 30 and are deflected outwardly to slide over the ramp as illustrated in FIG. 16 and on reverse rotation of the cap, the lugs engage the radial shoulder 32 of each of the cam elements to prevent continued rotation of the tamper-proof ring with the cap which in turn results in stressing and fracturing of the connecting bridges to separate the ring 22 from the cap. This separation of the retaining ring from the cap provides visual indicia or evidence that the cap has been once opened after it has been initially sealed. Note that the lugs are disposed in a horizontal plane of the cam elements when the cap is fully seated in the manner illustrated in FIG. 1 to insure engagement of the lugs with the cam shoulders when the cap is rotated to remove it.

As illustrated, the tamper-evident ring is of a larger diameter than the skirt of the cap and the container flange with the cam elements formed thereon permitting sufficient flexing of the ring to allow passage of the cam lugs over the cam elements without fracturing the bridges when applying the cap to the container. Note also the clearance between the ring and high point on the cam elements facilitating this action (see FIG. 16).

An important feature of the invention is the configuration and orientation of the connecting bridges which effects a sequential breaking of the bridges to free the tamper-proof ring when the cap is turned in a direction to remove it from the container and to thereby minimize the torque required to effect the breaking action and provide a better over-all control for cap removal. To this end, the tamper-evident ring 22 is secured to the lower terminal edge of the skirt of the cap by four circumferentially equi-spaced fracturable bridge connections 24*a*, 24*b*, 24*c* and 24*d*, each of which is disposed at a different angular orientation. For example, in FIG. 3, the bridge 24*a* at location 1 is disposed at an angle A of 0° and thus lies in a radial line or plane P aligned with the vertical axis A—A of the cap, the bridge 24*b* at location 2 is disposed at a small angle B to the plane P greater than angle A, the bridge 24*c* at location 3 is disposed at an angle C greater than the angle B and the bridge 24*d* at location 4 is disposed at still a greater angle D to the plane P.

Figure 3:
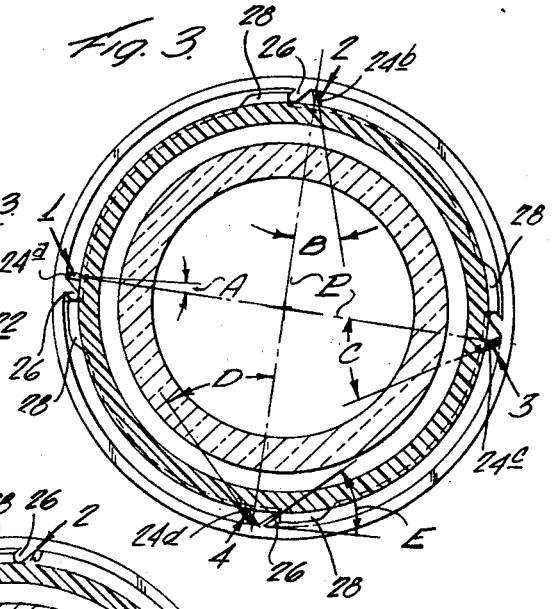
FIG. 3 is a sectional plan view taken on lines 3—3 of FIG. 1 prior to fracture of the bridges.
Figure 4:
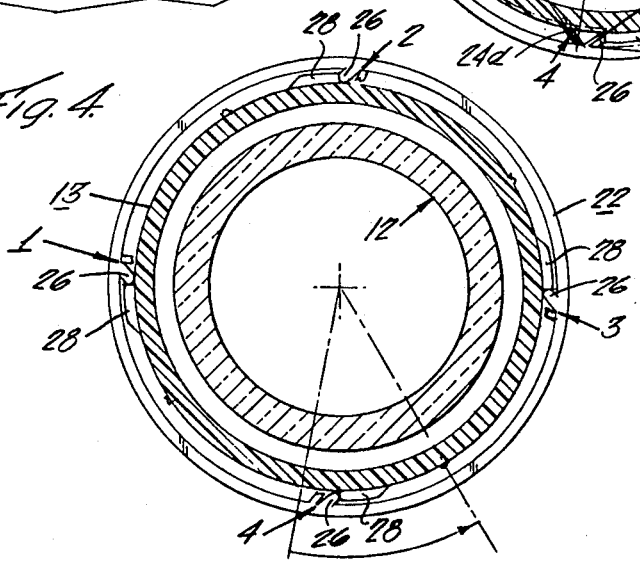
FIG. 4 is a view similar to FIG. 3 showing the cap rotated through a predetermined angle to fracture the bridges.
Figures 11, 11A, 11B, 11C:
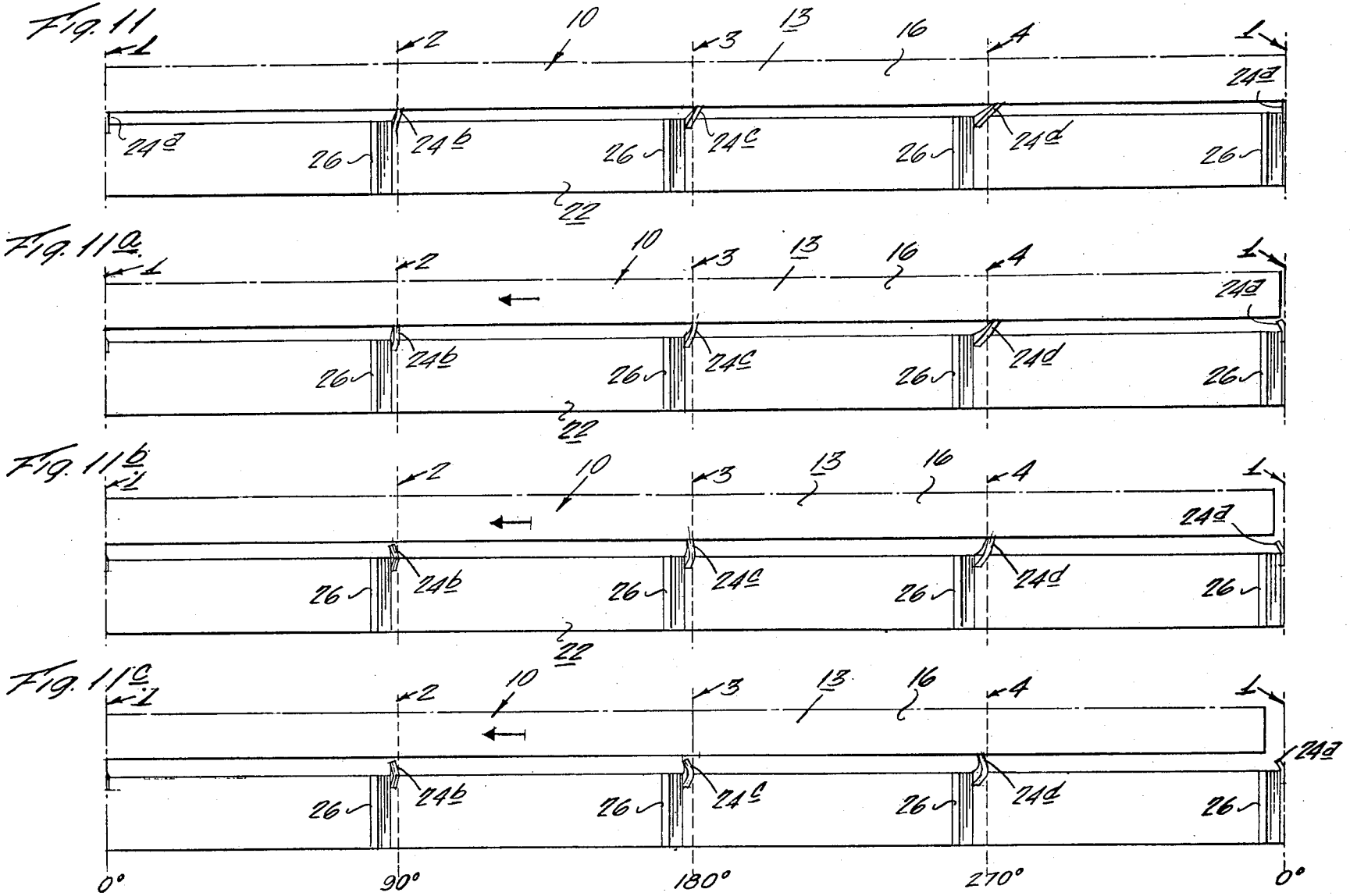
FIGS. 11, 11*a*, 11*b*, and 11*c* are developed views showing the sequential breaking of the bridges when the cap is rotated in the direction to remove it.

In the illustrated preferred embodiment, the lugs 26 are circumferentially equi-spaced relative to one another and the cam elements 28 are likewise circumferentially equi-spaced. The cam lugs 26 project at the same angle E to the axial plane of line P and are directed in an angular direction opposite the bridges 24. By this arrangement, all of the cam lugs 26 engage a shoulder 32 of one of the cam elements generally simultaneously as illustrated in FIG. 3 when the cap is rotated, in the present instance, in a counterclockwise direction to remove it from the container. By virtue of the different angular disposition of the connecting bridges, the bridge 24*a* at location 1 will fracture first since its effective bridge length La is less than the bridge lengths Lb, Lc and Ld at locations 2, 3 and 4, see FIG. 7 and the bridges 24*b*, 24*c* and 24*d* will fracture sequentially in that order since the bridge lengths are progressively greater. The bridges 24*b*, 24*c*, and 24*d* fracture in that order as illustrated in FIGS. 11–11*c* inclusive during a relatively small angular displacement of the cap 16. It is noted that the location of the connecting bridges 24 closely adjacent the location of the lug 26 adds a certain amount of rigidity and stabilizes the band; that is, the angular disposition of the bridges permits deflection of the retaining ring without breaking the band to permit passage of the lugs over the cam elements during the initial application of the cap to the container, (see FIG. 16).

Figure 14:
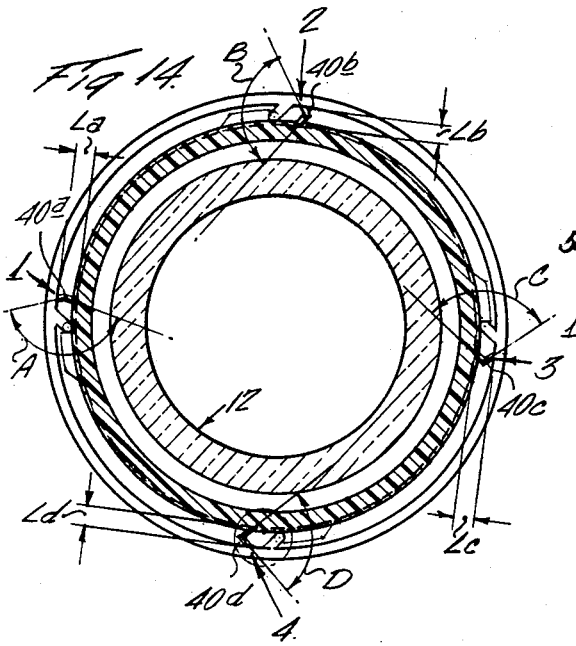
FIG. 14 is a sectional plan view similar to FIG. 3 showing an additional modification of the closure.
Figure 15:
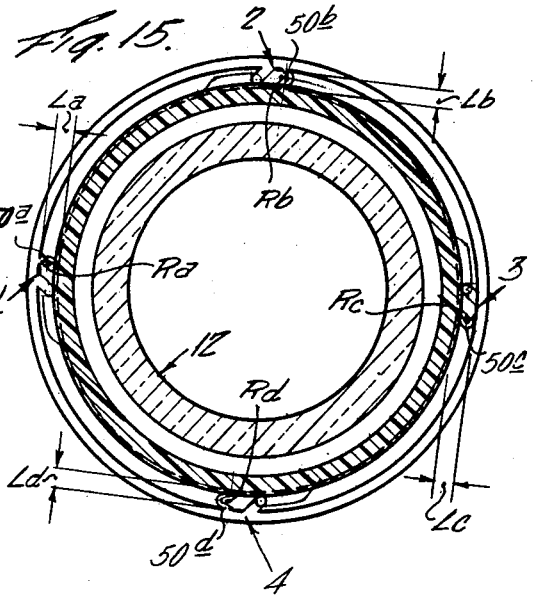
FIG. 15 is a view similar to FIG. 14 showing another modification.

There are illustrated in FIGS. 14 & 15 other embodiments of the container-closure in accordance with the present invention. The overall configuration of the closure and the container finish are generally the same as the principal embodiment and accordingly, the same reference numerals have been applied. However, in the present instance the bridges instead of being of a straight line configuration or shape, are either angled as shown in FIG. 14 or of arcuate cross section as shown in FIG. 15. In connection with the embodiment shown in FIG. 14 each bridge member 40*a*, 40*b*, 40*c*, 40*d* is of generally V-shaped cross section and the included angle of the leg sections 42*a*, 42*b*, 42*c* and 42*d* of each bridge decreases progressively in the present instance from location 1 through location 4. In this manner the desired sequential breaking is achieved by reason of the fact that the overall bridge length L′ increases progressively from location 1 through location 4.

In accordance with the embodiment illustrated in FIG. 15 the cross section of each bridge 50*a*, 50*b*, 50*c*, 50*d* is arcuate or curved and the radius of curvature decreases progressively from location 1 through location 4 to again effectively provide a progressively greater connecting bridge length L″ between the retaining ring and the cap from locations 1 through 4. Even though it is preferred to progressively increase the bridge length sequentially from locations 1 through 4, it is to be understood that other configurations providing a different sequence of sequential breaking are contemplated within the scope of the present invention.

Figure 12:
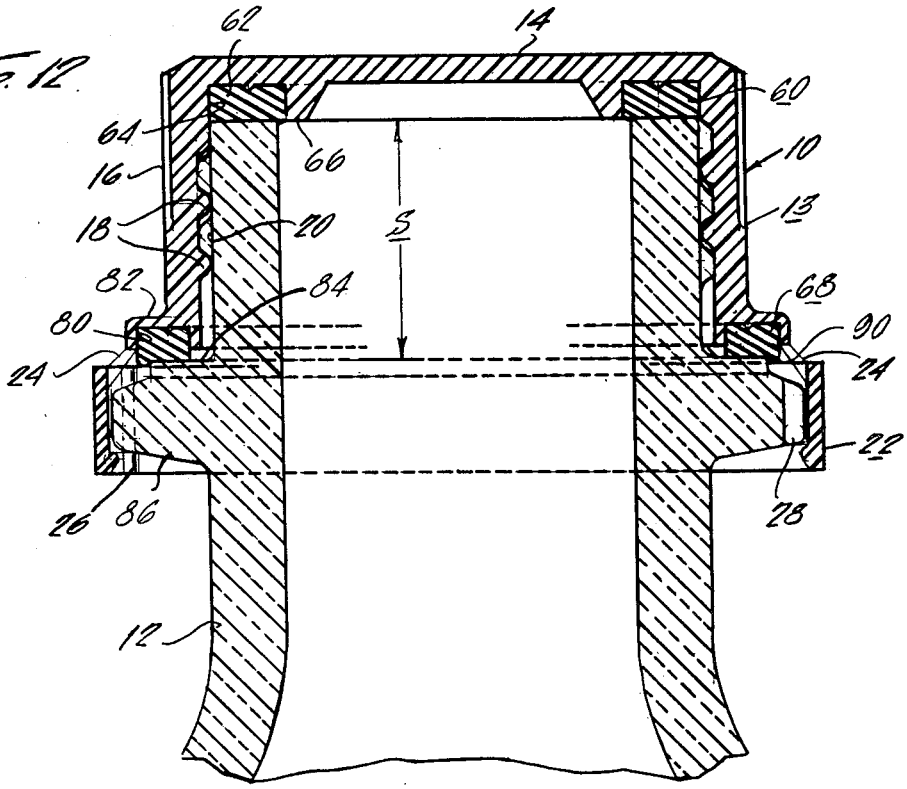
FIG. 12 is an enlarged fragmentary side elevational view of still another embodiment of the closure incorporating dual seal means in accordance with the present invention.
Figure 13:
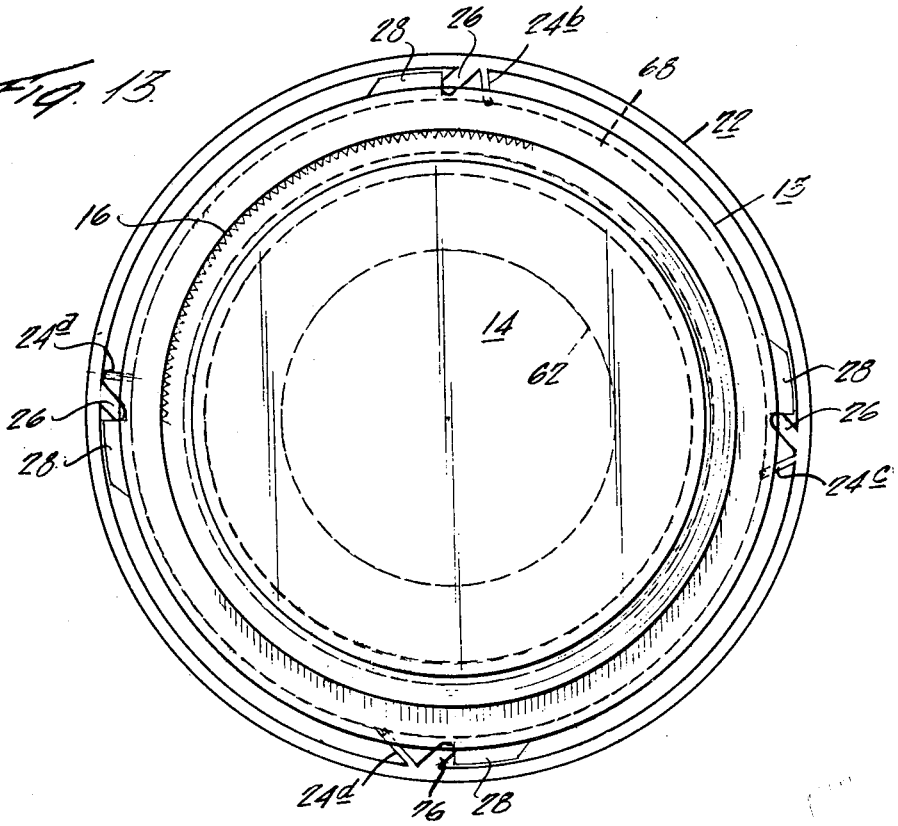
FIG. 13 is a top plan view of the assembly shown in FIG. 12.

There is illustrated in FIGS. 12 and 13 still another embodiment of closure assembly in accordance with the present invention. The overall configuration of the closure and container are generally similar to that described above and accordingly assigned identical reference numerals. New reference numerals are assigned to those features of the invention pertinent to this embodiment. In accordance with this embodiment of the invention, the closure is provided with dual seal means providing a seal between the inner face of the cap portion and the axial end face of the container and also the lower terminal edge of the skirt of the cap and a radially directed flange forming part of the container finish. The first seal means identified by the numeral 60 comprises an annular sealing ring 62 made of a flexible resilient material such as rubber which is supported in an annular groove 64 defined in part by the skirt and a central depending flange 66. The sealing ring 62 is held in place in the cap by a suitable adhesive. The second seal means comprises an annular sealing ring 68 which is seated in a pocket 80 formed in a radial flange-like extension 82 at the lower terminal edge of the skirt. As illustrated, the first seal ring 62 is of a radial width to completely overlie the axial end face of the container and has an inner marginal portion extending beyond the inner periphery of the opening defined therein. The second seal ring 68 is radially spaced from the neck of the container and seats on a smooth peripherally extending upper face 84 of the radial projection 86 below the threads on the neck of the container which also has formed thereon the cam elements for the tamper-evident ring. The second seal means also has an outer peripheral edge portion 90 which overlaps the outer edge of the sealing face or surface 84 of the flange projection 86. The upper sealing face 84 of the flange is spaced from the axial end face of the container a predetermined distance S so that when the cap portion of the closure is fully seated, the first and second sealing means bear against the axial end face of the container and the sealing surface of the flange with approximately equal sealing force. If desired, the first sealing ring may simply be supported in the corner of the inside of the closure without the use of the concentric flange defining the pocket therefor.

Even though various angular dispositions of the connecting bridges are possible to achieve the desired sequential breaking action, the following chart provides an orientation and dimensional relationship of the bridges which is effective to provide the desired small torquing action for a 28 mm closure in accordance with the present invention.

| CONTAINER-CLOSURE ASSEMBLY OF FIGS. 1-10 | |
|---|---|
| Cross section (T) of the bridges | 0.025 inches |
| Angle A of bridge 24a at location 1 | 0° |
| Angle B of bridge 24b at location 2 | 15° |
| Angle C of bridge 24c at location 3 | 30° |
| Angle D of bridge 24d at location 4 | 45° |
| Bridge length La of bridge 24a | .021 inches |
| Bridge length Lb of bridge 24b | .022 inches |
| Bridge length Lc of bridge 24c | .024 inches |
| Bridge length Ld of bridge 24d | .030 inches |

| CONTAINER-CLOSURE ASSEMBLY OF FIG. 14 | |
|---|---|
| Cross section (T) of the bridges | 0.025 inches |
| Included Angle A of bridge 40a at location 1 | 0-170° |
| Included Angle B of bridge 40b at location 2 | 140° |
| Included Angle C of bridge 40c at location 3 | 110° |
| Included Angle D of bridge 40d at location 4 | 80° |
| Bridge length La of bridge 40a | .021 inches |
| Bridge length Lb of bridge 40b | .022 inches |
| Bridge length Lc of bridge 40c | .026 inches |
| Bridge length Ld of bridge 40d | .033 inches |

| CONTAINER-CLOSURE ASSEMBLY OF FIG. 15 | |
|---|---|
| Cross section (T) of the bridges | 0.025 inches |
| Radius Ra of bridge 50a at location 1 | .018 inches |
| Radius Rb of bridge 50b at location 2 | .014 inches |
| Radius Rc of bridge 50c at location 3 | .012 inches |
| Radius Rd of bridge 50d at location 4 | .011 inches |
| Bridge length La of bridge 50a | .022 inches |
| Bridge length Lb of bridge 50b | .024 inches |
| Bridge length Lc of bridge 50c | .026 inches |
| Bridge length Ld of bridge 50d | .028 inches |

There is illustrated in FIG. 16 a further modification of closure assembly in accordance with the present invention. The overall construction and arrangement of the closure are similar to the principal embodiment. However, in this instance, additional lugs 26*a* are provided between the lugs 26 at locations 1, 2, 3 and 4. These additional lugs add a measure of safety to insure against backing off during autoclaving for example and also provide better security against breaking the seal between the cap and the container either accidentally or intentionally before the cap is turned a great enough angular distance to break the bridges. In the present instance, an additional pair of lugs 26*b* is provided between adjacent lugs in each quadrant. The optimum number of lugs will vary with cap size and type of threads and in general the larger the cap size, the greater number of lugs.

Even though particular embodiments of the invention have been illustrated and described herein, changes and modifications may be made therein within the spirit and scope of the present invention. For example, even though the preferred arrangement is to space the bridges 24 equally about the circumference of the cap for considerations primarily effecting ease of manufacturing, the bridges 24 can be randomly spaced to still achieve the desired sequential breaking action. Also, the number and location of the lugs may be varied and the closure operates effectively with as little as one lug.

What is claimed is:

1. A closure for containers having a discharge opening and a finish with means for supporting the closure over the discharge opening comprising a cap portion of generally cup-like form having a top and a depending skirt with means on the interior peripheral surface thereof cooperating with means on the container finish for applying and removing the cap portion; a tamper-evident ring connected to the lower terminal edge of said skirt by at least two fracturable bridge means and at least one lug cooperatively associated with at least one cam element below the container finish operable in one direction of movement of the cap portion relative to the container to effect fracturing of the bridge means to separate the tamper-evident ring from the cap portion, said bridge means being oriented in a predetermined manner relative to one another to effect sequential breaking of said bridge means in a given pattern upon relative movement of said cap portion and ring in said one direction.

2. A closure as claimed in claim 1 wherein said bridge means comprises at least two fracturable bridge members connecting the tamper-evident ring to said skirt, each of said bridge members being disposed at a different angle providing varying bridge lengths for each of the bridge members whereby upon actuation of said cap relative to said ring, said bridge members fracture sequentially.

3. A closure as claimed in claim 1 wherein said means comprises bridge members of V-shaped cross section and wherein the leg portions of said bridge members are connected to the skirt and ring respectively, the included angle between said leg portions of each of said bridge members being different to thereby provide a varying bridge length for each of the bridge members so that upon relative movement of said cap portion and said ring, the bridge members fracture sequentially.

4. A closure as claimed in claim 1 wherein the bridge means comprises bridge members of arcuate cross section and the radius of curvature of each of the bridge members is different so that upon relative movement of said tamper-evident ring and cap the bridge members break sequentially.

* * * * *